United States Patent [19]

Tar et al.

[11] Patent Number: 4,737,089

[45] Date of Patent: Apr. 12, 1988

[54] ECCENTRIC PUMP WITH LOCK VALVE, MAINLY FOR THE LUBRICANT CIRCULATION OF DRIVES

[75] Inventors: Lóránt Tar; András Tassy, both of Györ, Hungary

[73] Assignee: Magyar Vagon - Es Gepgyar, Budapest, Hungary

[21] Appl. No.: 888,777

[22] Filed: Jul. 22, 1986

[30] Foreign Application Priority Data

Aug. 1, 1985 [HU] Hungary ..... 2951/85

[51] Int. Cl.[4] ..... F04C 2/344

[52] U.S. Cl. ..... 418/64; 418/65

[58] Field of Search ..... 418/64, 65; 73/257

[56] References Cited

U.S. PATENT DOCUMENTS

| | | | |
|---|---|---|---|
| 2,187,730 | 1/1940 | Davidson | 418/64 |
| 2,604,052 | 7/1952 | Eickele | 418/64 |
| 4,265,605 | 5/1981 | Ito | 418/64 |

FOREIGN PATENT DOCUMENTS

| | | | |
|---|---|---|---|
| 2262574 | 6/1974 | Fed. Rep. of Germany | 418/64 |
| 642498 | 7/1962 | Italy | 418/64 |
| 4727 | of 1878 | United Kingdom | 418/64 |

*Primary Examiner*—John J. Vrablik

*Attorney, Agent, or Firm*—Schweitzer & Cornman

[57] ABSTRACT

Subject of the invention is an eccentric pump with lock valve, mainly for the lubricant circulation of drives, provided with case of inner cylindrical surface fixed with tangential support and having pressure and suction connections, furthermore with shaft sealed and voncentrically embedded leading through the case, liquid chamber closed between the case and the shaft, confined by parallel planes on the side, round eccentric part arranged on the shaft, rectangular sectional ring pressed to the cylindrical inner wall of the case by the eccentric part in a point of contact moving from the pressure connection to the suction connection, as well as a lock valve separating the suction and pressure connections from each other by way of sealing. According to the invention, the lock valve is formed as an externally tangentially support pin (9), the end of which is flattened inside the case (1) and fixed in the radial hole of the case (1) communicating with the suction and pressure connections (7,8), while the ring (4) pressed by the eccentric part to the inner wall of the case (1) is provided with a radial slot (10) connected to the flattened end of the pin (9) by way of self-adjustment and sealing.

5 Claims, 5 Drawing Sheets

ECCENTRIC PUMP WITH LOCK VALVE, MAINLY FOR THE LUBRICANT CIRCULATION OF DRIVES

Figure 2:
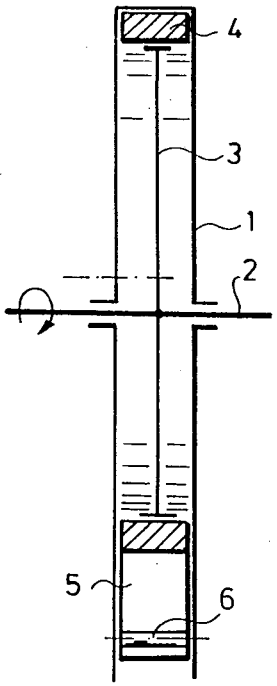
Fig. 2 PRIOR ART

The invention relates to an eccentric pump with lock valve, mainly for the lubricant circulation of drives, which can be mounted directly on to the power transmission shaft to be lubricated, or may be applied as an intermediate device.

Different types of pump (gear pump, screw pump, rotary pump, etc.) are used for the lubricant circulation of drives. Their common charasteristics is that they contain a relatively large number (twenty-thirty) of parts making the cost of production high. Furthermore, none of the known types would allow their mounting on the shaft of a drive, for example between a bearing and a gear because of their dimensions and construction of the rotary shaft. Therefore a free shaft-end or separate power transmission unit, gear, chain, etc. are necessary for their driving. These partly further increase the costs, and partly the volume of the drive and the number of the parts as well. Thus not only the complexity and the price of the mechanism will increase, but its technical parameters will also deteriorate, since the building in of a smaller mechanism, but of the same purpose would result in increasing the pay-load. Apart from this, failure of the mechanisms consisting of many parts, will be more frequent.

For the elimination of above drawbacks, mostly the eccentric pumps with lock valve seemed to be suitable by their relatively simple build-up, these however were not used in the technical practice for the mentioned purpose, especially not mounted directly on to the power transmission shaft to be lubricated. The eccentric pumps with lock valve are generally characterized in that the space between the pump case and an internal eccentric rotary part is divided during rotation by the contact point of the case and the rotary part moving from the suction connection to the pressure connection and by a lock valve into an expanding suction chamber and a reducing pressure chamber, at the same time the liquid is sucked into the suction chamber and discharged from the pressure chamber. Such construction is also known, where the lock valve is built into the case with spring support, and another one where as the extension of a ring driven around by the eccentric rotary part coacts with a self-adjusting sliding quide.

The object of the present invention is therefor to provide a simple construction with easily producible minimal number of parts (altogether four in marginal case), and to make it suitable for mounting directly on to driving shafts with minimal space requirement.

According to the invention, the lock valve is formed as an externally tangentially supported pin fixed in the radial hole of the case communicating with the suction and pressure connections, and the end of the pin is flattened inside the case, while the ring pressed to the inner wall of the case by the eccentric part is provided with a radial slot, the connection of which with the flat end of the pin is selfadjusting and sealed.

As a result of this, the build-up of both the ring and the lock valve becomes simpler, the production and assembly are easily carried out. (Only machining of the planes and cylindrical surfaces is necessary.) The cost of production, and the small space requirement allow the mounting of several such pumps within the same oil chamber in case of necessity.

One of the simplest, easily assembled and produced embodiments of the invention is characterized in that the eccentric part is formed as a groove machined in the outer mantle of the shaft, in which the split ring is arranged by way of snapping in.

For the direct lubrication of the driving shaft the construction is particularly facourable, where the split ring is provided in the vicinity of the flattened end of the pin with a pressure connection substituting radial transfer hole oriented towards the eccentric part, while the eccentric part is provided with a circular groove communicating with the transfer hole of the ring and through the internal holes with the internal lubrication channel of the shaft.

The upper pressure limit of the delivered liquid can be set in a simple way by the pump according to the invention, where one side of the groove of the eccentric part is formed by a spring-supported stop collar associated with a pretensioning shaft nut.

Figure 1:
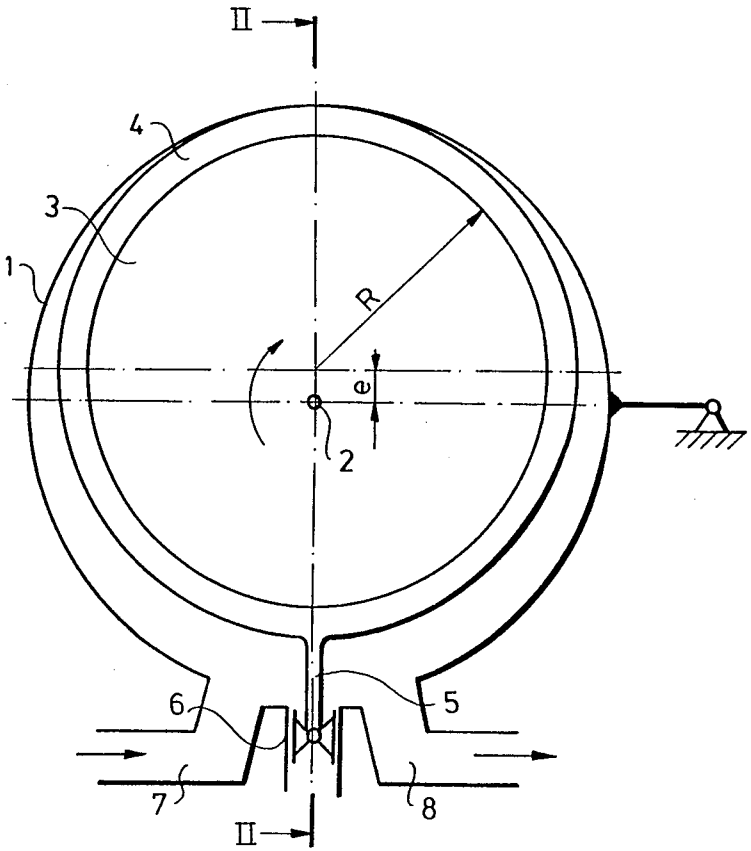
Fig. 1 PRIOR ART
Figure 3:
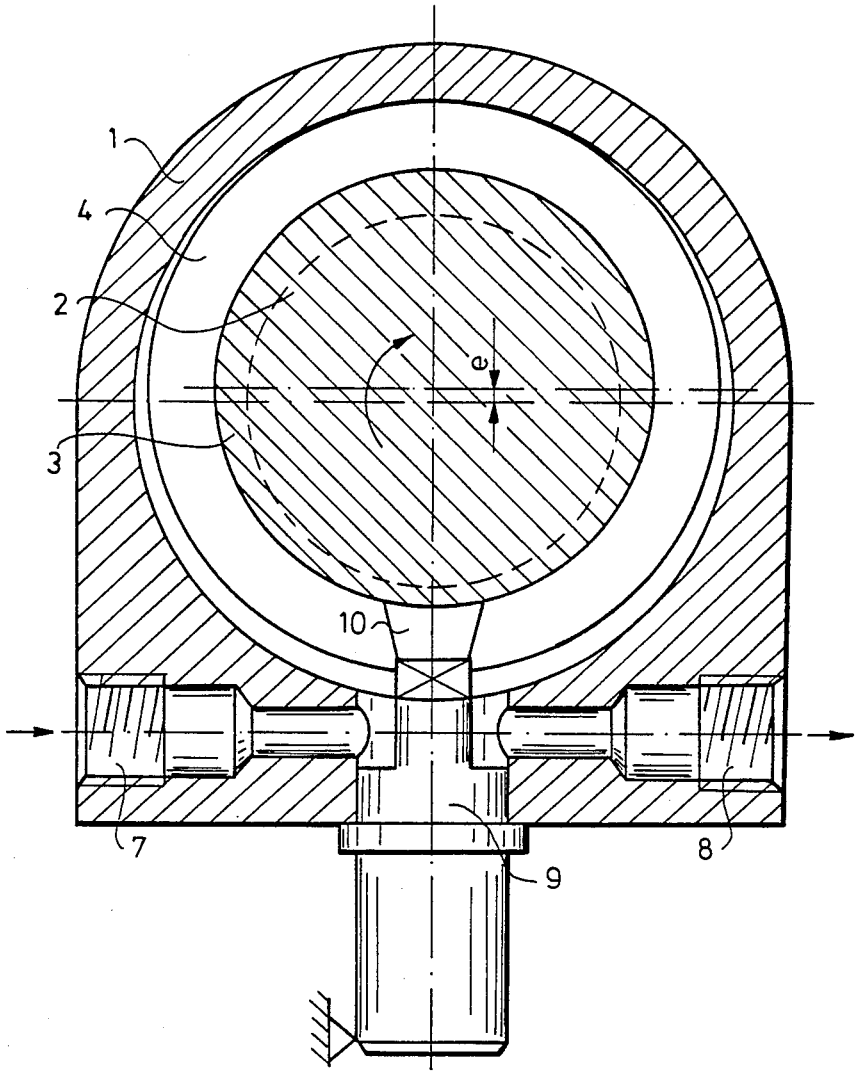
Figure 5:
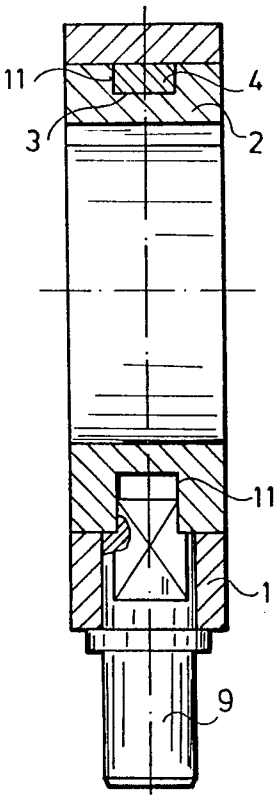
Figure 4:
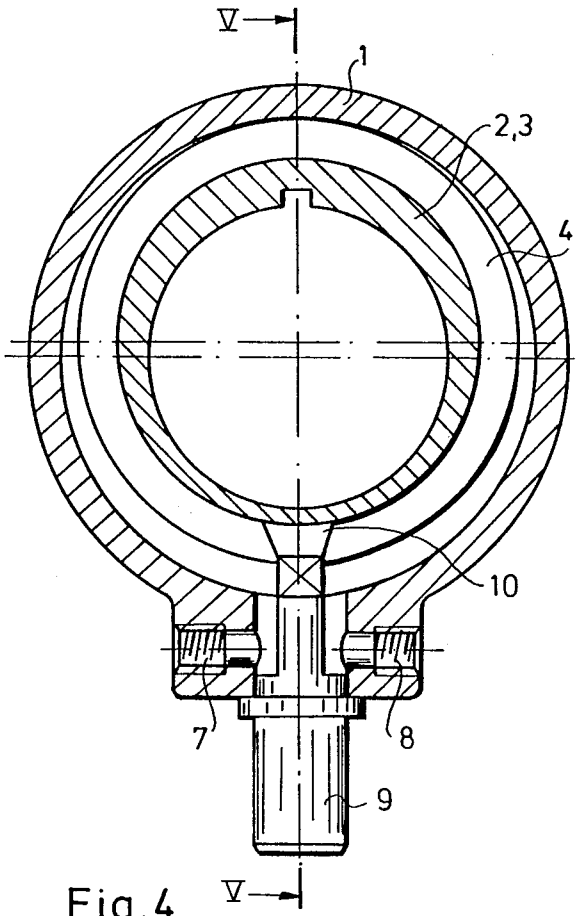
Figure 7:
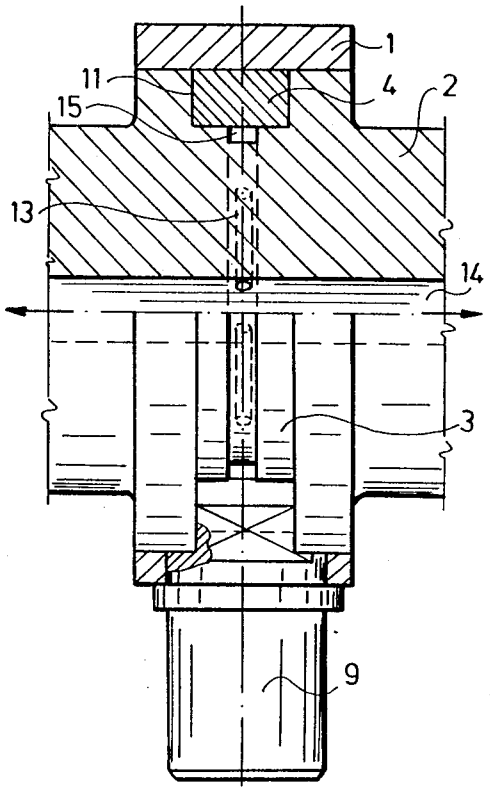
Figure 6:
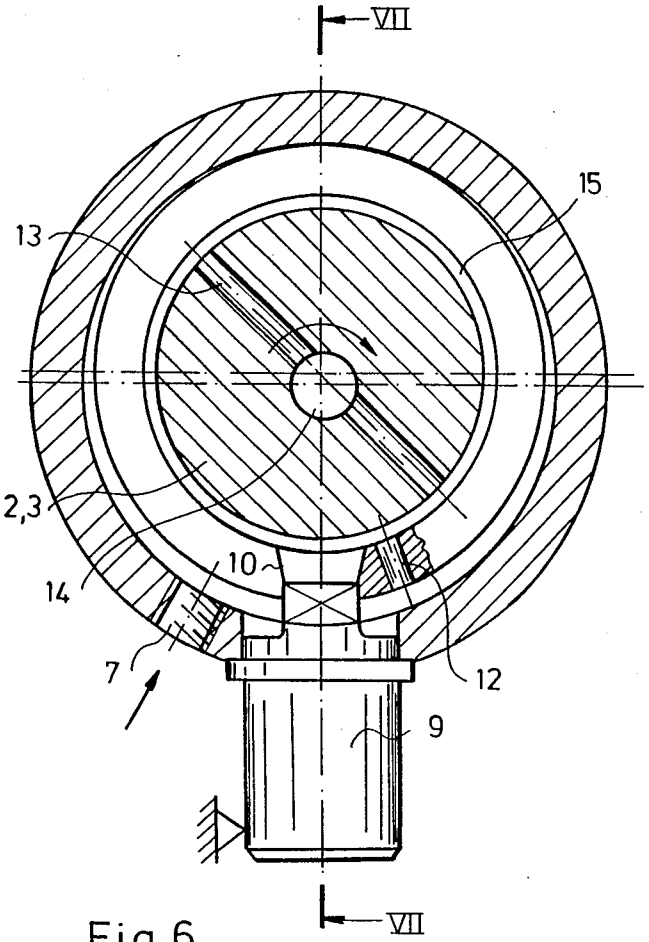
Figure 8:
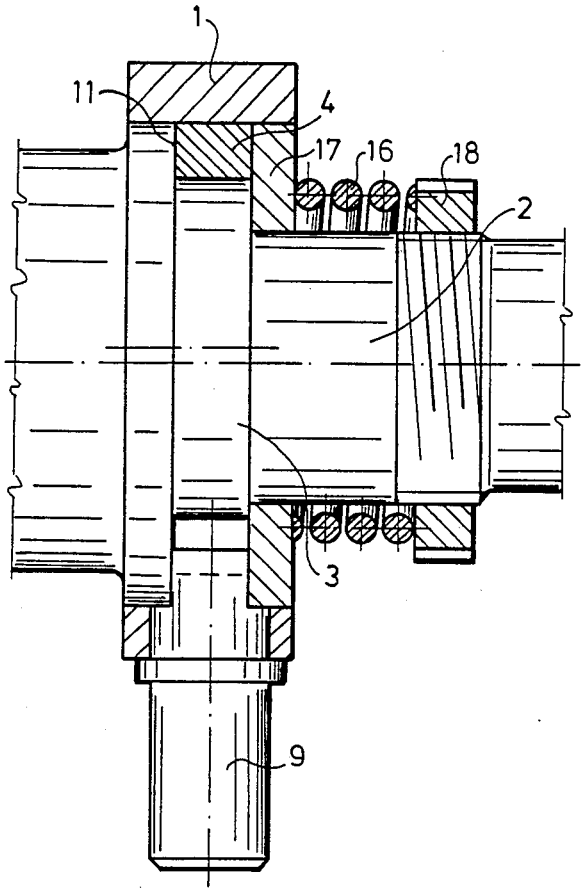

The invention will be described herebelow in detail by way of examples with the aid of drawing, in which:

FIG. 1 is a schematic build-up of a swing valved version of the conventional eccentric pump with lock valve, FIG. 2 is a longitudinal section along line II—II of FIG. 1, FIG. 3 is the cross section of an eccentric pump with lock valve according to the invention, FIG. 4 is the cross section of the eccentric pump with lock valve according to the invention mounted directly on to the power transmission shaft, including the eccentric part formed as a groove, FIG. 5 is the longitudinal section along V—V of the pump shown in FIG. 4, FIG. 6 is the cross section of a further possible construction of the eccentric pump with lock valve according to the invention, FIG. 7 is the longitudinal section along VII—VII of the pump shown in FIG. 6 and FIG. 8 is the longitudinal section of the eccentric pump with lock valve according to the invention provided with upper pressure limit control.

For the sake of comparison of the solution according to the invention shown in FIGS. 1 and 2, the swing valved embodiment of a conventional eccentric pump with lock valve is presented. This pump is provided with a case 1 fixed with tangential support, and confined by parallel planes on both sides and having cylindrical inner surface, furthermore with a shaft 2 leading through the case 1 fitted with concentric and sealed bearing. A round eccentric part 3 with radius R is mounted on the shaft at a distance e from the centre, surrounded by a rectangular sectional ring 4. The ring 4 has an extension 5 forming the lock valve (swing valve), which coacting with a self-adjusting sliding quide 6 separates the pressure connection 8 and suction connection 7 of the case 1. During rotation of shaft 2, the eccentric part 3 mounted on the shaft 2 presses the ring 4 by way of sealing it to the inner wall of the case 1 in the point of contact moving from the pressure connection 8 to the suction connection 7, thus an expanding suction chamber and a reducing pressure chamber will develop between the inner wall of case 1 and the ring 4, while the pump sucks in the liquid through the suction connection 7 and discharges it through the pressure connection 8.

The pump according to the invention shown in FIG. 3 functions according to a similar principle. Here however - for the sake of simplicity - the lock valve is formed by a pin 9 with flattened end pressed into the radial hole of the case 1, and the slot 10 of the radially split ring 4 is connected to the flattened end by way of self-adjustment and sealing. The pressure connection 8 and suction connection 7 are also connected to the flattened end of pin 9, while the end of pin 9 extending from the case 1 serves for the tangential support of the case 1. The rotary liquid chamber - similarly to the earlier described solution -is formed between the outer mantle of ring 4 controlled by the eccentric part 3 and the internal cylindrical surface of the case 1, while the eccentric part 3 rolls down on the internal mantle of the stationary ring 4 and according to the eccentricity it presses the ring 4 to the case 1.

The slot 10 of ring 4 enables a small displacement and angular setting on the pin 9, since it is controlled by the eccentric part 3, furthermore the pin 9 is squared off to facilitate its mounting. The so-formed sealing edge closes the passage of the liquid at pin 9. Pressing the sealing edge of ring 4 to the pin is facilitated by the liquid pressure applied to the mantle of ring 4 on the high pressure side in the liquid chamber.

In order to increase the efficiency, a rolling bed is built in between the eccentric part 3 and ring 4.

A pump built directly on a power transmission shaft or with an external and internal ring similarly to the rolling bearing can be produced as shown in FIGS. 4 and 5, where the shaft 2 to be lubricated is fitted into the hole of a pipe-shaped case 1, and the liquid chamber together with the split ring 4 is arranged in groove 11 formed as the eccentric part 3 of shaft 2. The ring can be snapped into the groove 11. The liquid chamber rotating in the groove 11 of shaft 2 is divided into two parts by the flattened pin 9 with angular end which fills out the full width of the groove 11 of shaft 2, thus it guides the case 1 and shaft 2 in relation to each other, at the same time it extends into the slot 10 of ring 4 allowing its self-adjustment and sealing, where - depending on the direction of rotation - the rotary liquid chamber (e.g. oil chamber) constantly expands on one side of the pin 9, while it is reduced on the other side. The existing direction of rotation determines on which side is the suction or pressure branch of the pump arranged, since buildup of the mechanism is symmetric. In case of hydraulic motor the direction of rotation can be reversed by connecting the high pressure line to the other stub.

If the pump delivers oil from an external space into a lubricating channel inside the shaft 2 (e. g. main shaft of an engine), then the use of the embodiment shown in FIGS. 6 and 7 is advisable. Here the split ring 4 is provided in the vicinity of the flattened end of pin 9 with a pressure connection-substituting radial transfer hole 12 oriented towards the eccentric part 3, while the eccentric part 3 has a circular groove 15 communicating with the transfer hole 12 of ring 4 and with the internal lubrication channel 14 of shaft 2 through internal holes 13.

This way, the lubticant entering through the suction connection 7 is delivered through the transfer hole 12 of ring 4, circular groove 15 of the eccentric part 3, then through holes 13 and lubrication channel 14 machined in the shaft 2 directly to the part to be lubricated.

For limitation of the upper pressure value of the liquid, the use of solution shown in FIG. 8 is advisable. Here on side of the groove 11 of eccentric part 3 is formed by a spring-supported 16 stop collar 17, where a shaft nut 18 is used for the pretensioning of spring 16. Should the pressure excesseively increase, the stop collar 17 moves against the spring 16, whereby the pump is shorted, since the liquid chamber in the groove 11 of case 1 is no longer closed. By adjusting the threaded shaft nut 18 on the shaft 2, the pretensioning of the spring 16 and the maximum pressure value are variable.

The pump according to the invention does not require special maintenance, and no special skill is needed for its operation. Incidental wear of the sealing edge of the ring at the lock valve (pin) does not influence the functioning and the pressure, because the sealing edge is pressed to the end of the pin by the resultant of the pressure of the liquid chamber on the pressure side, but also by the pin friction arising as a result of the rotation of the eccentric part 3. The risk of failure is minimal by the simplicity of the mechanism, hence its operation is reliable. The minimal wear of the parts and their excellent lubrication provide extremely long life.

The mechanism is extremely simple (in its simplest form it consists only of four parts confined by cylindrical and flat surfaces) whereby it can be produced at a very low cost, with traditional machines.

The reasonable cost of the pump makes it worth considering to arrange several pumps of the type within the same oil chamber, whereby the pipes used for delivery of the lubrication can be dispensed with, because the pump arranged directly at the lubrication point, makes their use unnecessary. On account of the low cost of production, the periodically functioning mechanism can be made to be steady with several parallel connected chambers and pressure periods offset according to the angular displacement of the strokes of the multi-cylindrical, pistoned internal combustion engines, if this is required by the mechanism into which it is built in.

The angular displacement of the chambers in relation to each other may be optional, depending on the number of chambers. The chambers can uniformly be distributed along the circle according to the full rotation when used as pump or as steady running hydraulic motor.

The efficiency of the pump depends on the factory tolerances. Thus, the tolerance range in a pump used in a low pressure system will be wide, consequently the parts will be less expensive. Applying a close tolerance, a pump of higher pressure and efficiency can be produced. Thus the price is in harmony with the purpose of the pump. The efficiency can be improved by building in oil seals, if required.

A very favourable property of the pump according to the invention is that it can be built directly on to the shaft, no drive is required, its need of space is minimal, moreover on case of machining an eccentric groove on the shaft, it can be realized with further three parts. In the size of a small ball bearing it is capable to carry out the lubrication as a small gear drive.

The invention offers the possibility for the delivery of lubricant sucked in from the outside into the oil chamber arranged in the interior of the rotary shaft, whereby it provides direct lubrication when built on the main shaft of an engine.

The simplicity of the pump is due to the fact, that all parts are utilized many times in respect of functioning, which assist the functioning of each other, and are in full accord with the field of application. E.g. the resultant of the liquid pressure of the pressure chamber and the friction force assist the sealing of the ring.

Wear of the parts is minimal, with coated parts of suitable quality the life of the pump can be considerably extended.

What we claim is:

1. In an eccentric pump particularly for the circulation of lubricant in drive mechanisms and of the type comprising (a) a housing provided with a cylindrical inner chamber-forming surface defining a fluid chamber, (b) a shaft extending axially through said housing and mounted for rotation about an axis concentric with the axis of said chamber-forming surface, (c) said shaft having an eccentric portion with said housing, (d) a sealing ring surrounding said eccentric portion and movable thereby in progressive moving contact with said chamber-forming surface, (e) seal forming means in said chamber-dividing said chamber into a suction side and a pressure side, and (f) suction and pressure ports in said pump communicating respectively with said suction and pressure sides of said chamber, the improvement characterized by (g) said seal forming means comprising a lock pin, (h) said housing having an opening therein extending into said chamber from the outside, (i) said lock pin being received in said opening and having a chamber-dividing element projecting radially into said chamber, (j) said sealing ring comprising a split ring having spaced end surfaces, (k) said spaced end surfaces sealingly engaging said chamber dividing element on opposite sides thereof.

2. The improvement of claim 1, further characterized by (a) said opening for receiving said lock pin comprising a radial bore in said pump housing, (c) said lock pin having a portion of circular cross section received in said bore, (b) said lock pin having a portion of rectangular cross section projecting into said chamber and forming said chamber-dividing element, (d) said chamber-dividing element having two sides engaging end walls of said chamber and two sides engaged by ends of said split ring.

3. The improvement of claim 1, further characterized by (a) said lock pin having a portion extending outwardly of said housing for cooperation with external support means against rotation.

4. The improvement of claim 2, further characterized by (a) the portion of circular cross section of said lock pin extends only partially through said bore, (b) said lock pin serving to close and seal outer portions of said bore, (c) said lock pin being recessed on opposite sides throughout inner portions of said bore to form fluid chambers, (d) said suction and pressure ports communicating with said fluid chambers.

5. The improvement of claim 4, further characterized by (a) said lock pin being recessed on opposite sides by being flattened to form parallel flat surfaces, (b) said parallel flat surfaces projecting into said chamber and forming said chamber dividing element.

* * * * *